United States Patent [19]

Stathopoulos

[11] 4,406,347

[45] Sep. 27, 1983

[54] MODULAR STAIRCASE ASSEMBLY

[76] Inventor: Nicholas M. Stathopoulos, 3968 Marine Ave., Powell River, British Columbia, Canada

[21] Appl. No.: 252,741

[22] Filed: Apr. 10, 1981

[30] Foreign Application Priority Data

Mar. 30, 1981 [CA] Canada ..... 374167

[51] Int. Cl.[3] ..... E06C 1/38; E06C 7/08; E06C 9/00

[52] U.S. Cl. ..... 182/1; 52/183; 182/97

[58] Field of Search ..... 182/1, 96, 95, 156, 182/195, 163, 164, 159, 33.5, 93, 97, 194, 215; 52/183, 97

[56] References Cited

U.S. PATENT DOCUMENTS

| | | | |
|---|---|---|---|
| 298,212 | 5/1884 | Knight | 182/1 |
| 300,395 | 6/1884 | Peterson | 182/97 |
| 1,555,847 | 10/1925 | Hudson | 182/178 |
| 2,245,825 | 6/1941 | Ross | 182/156 |
| 3,474,882 | 10/1969 | Ernst | 182/178 |
| 3,493,077 | 2/1970 | Doten | 182/156 |
| 3,713,511 | 1/1973 | Hinkle | 182/1 |
| 3,731,761 | 5/1973 | Glenn | 182/1 |
| 4,086,980 | 5/1978 | Shortes | 182/178 |

FOREIGN PATENT DOCUMENTS

| | | | |
|---|---|---|---|
| 32594 | 12/1962 | Finland | 52/183 |

*Primary Examiner*—Reinaldo P. Machado
*Assistant Examiner*—Alvin Chin-Shue
*Attorney, Agent, or Firm*—Townsend and Townsend

[57] ABSTRACT

A modular staircase assembly having a plurality of individual interconnecting upper and lower stringer members including a means for coupling upper and lower stringer members and a means for interconnecting in longitudinal alignment adjacent stringer members. Affixed to each set of upper and lower stringer members is a tread support for supporting a tread which is pivotally couplable to the associated upper and lower stringer sections so that when assembled and one of the upper and lower stringer sections is slid relative to the other the tread support moves so as to maintain a substantially horizontal position. Rotatable foot pads and mounting pads coupled to either end of the assembled structure accommodate changes in orientation of the staircase assembly.

11 Claims, 7 Drawing Figures

3
61
20
57
18
46
17
28
29
10
16
26
12
22
84
82
77
80
86
72
102
104
40
38
64
19

MODULAR STAIRCASE ASSEMBLY

BACKGROUND OF THE INVENTION

The present invention relates to an adjustable staircase assembly.

Conventional adjustable staircase assemblies generally include stringers of a fixed length coupled by various means to each other and to tread supports and, in some cases, arm rails. Many of the known modular assemblies require the drilling of holes in order to install tread supports and the like and/or require a large number of bolts or pins in the assembly of the structure. Significantly, none of the known modular staircase assemblies utilize modular stringers. Known staircase assemblies require separate stringers for supporting the steps the stringers being tailored to the required length and pitch of the staircase.

SUMMARY OF THE INVENTION

According to the present invention there is provided a modular staircase assembly which includes a plurality of upper stringer members and lower stringer members. Means are provided for coupling the upper and lower stringer members in parallel spaced apart relationship so that one of the upper and lower members in slidable with respect to the other. Means are provided for connecting a first end of the upper and lower stringer members to a second end thereof, adjacent respective upper and lower stringer members so that the connected members are longitudinally aligned. A tread support is pivotally couplable to the upper and lower stringer sections and provides a means for supporting one end of a step section. A mounting pad assembly is couplable to one of the first and second ends of the upper and lower stringer members for mounting to a wall portion. A foot pad assembly is couplable to the other of the first and second ends of the upper and lower stringer members for mounting on a floor portion.

Advantageously, the stringer coupling means is a coupling member rigidly affixable to one of the upper and lower stringer members and has a projecting arm which extends perpendicularly from one stringer member when assembled, the distal end of the arm having an opening for snugly slidably receiving the other stringer member.

Preferably, the stringer connecting means includes a coupling member rigidly affixable to the first end of each of the upper and lower stringer members having a receptacle of substantially the same cross section as the associated stringer member and aligned therewith for snugly slidably receiving a second end of an adjacent stringer member.

The stringer coupling means and stringer connecting means for one of the upper and lower stringer members may including a coupling member rigidly affixable to the first end of the one stringer member and having a receptacle of substantially the same cross section as the one stringer member and aligned therewith. The coupling member when affixed to the one stringer member may have a projecting arm extending perpendicularly from the one stringer member, the distal end of the arm having an opening for snugly slidably receiving the other stringer member. The stringer connecting means for the other stringer member may include a sleeve rigidly affixable to the first end of the other stringer member and having a receptacle of substantially the same cross section as the other stringer member for snugly slidably receiving a second end of an adjacent stringer member.

The stringer coupling means and the stringer connecting means together with the tread support and a portion of the stringer member forms a triangle which provides an extremely strong configuration as well as minimizing the number of required connecting bolts and other elements necessary to assemble the structure.

Finally the provision of adjustable stringers for the assembly permits a simple tailoring of the assembled staircase to meet any required pitch and the length to the simple expedient of adding or deleting one or more stringer members onto either side of the step elements.

BRIEF DESCRIPTION OF THE DRAWINGS

In drawings which illustrate embodiments of the invention;

FIG. 3 is a side elevational sectional view of the staircase assembly shown in FIG. 1 having a steeper inclination than that of the assembly as seen in FIG. 2;

DETAILED DESCRIPTION OF EMBODIMENTS OF INVENTION

In the following discussion words such as "upper", "lower", "top" and "bottom" are used in a relative sense rather than in an absolute sense. In the different figures like reference numbers refer to like parts.

Figure 1:
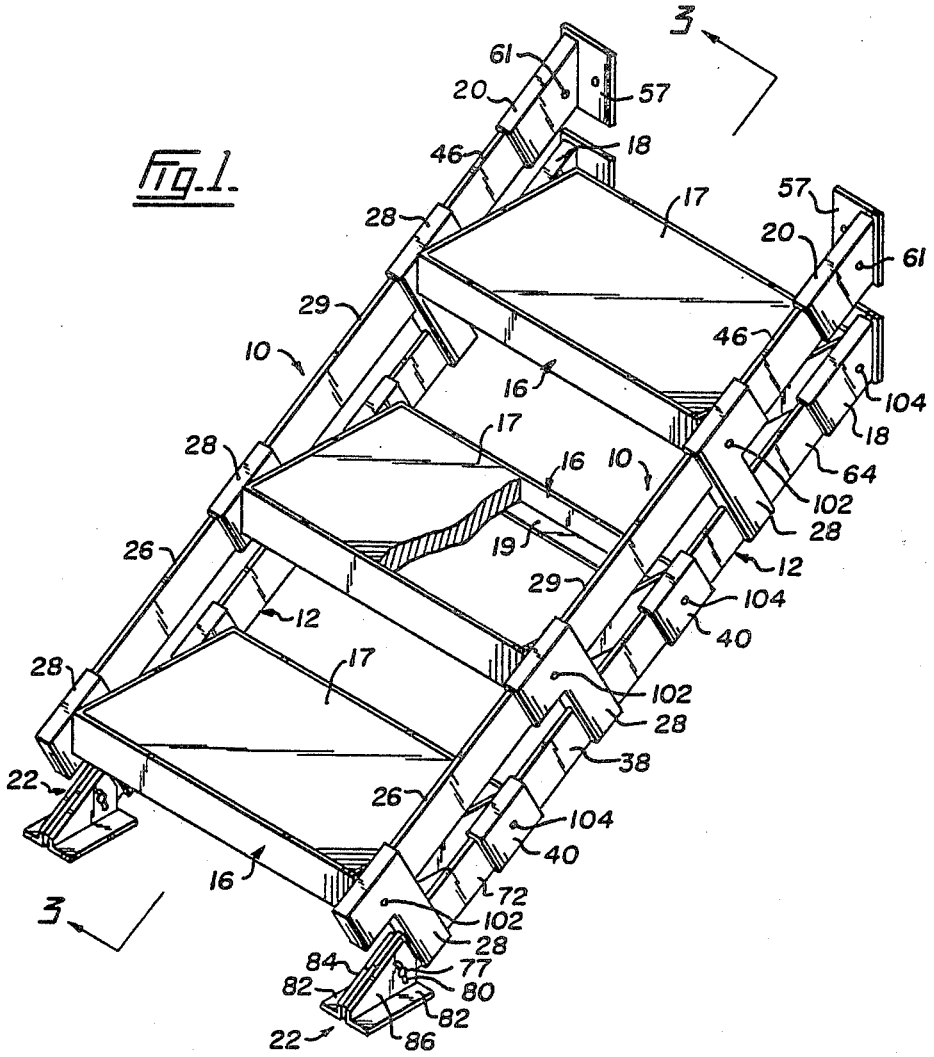
FIG. 1 is a perspective view of the assembled modular staircase assembly.
Figure 1:
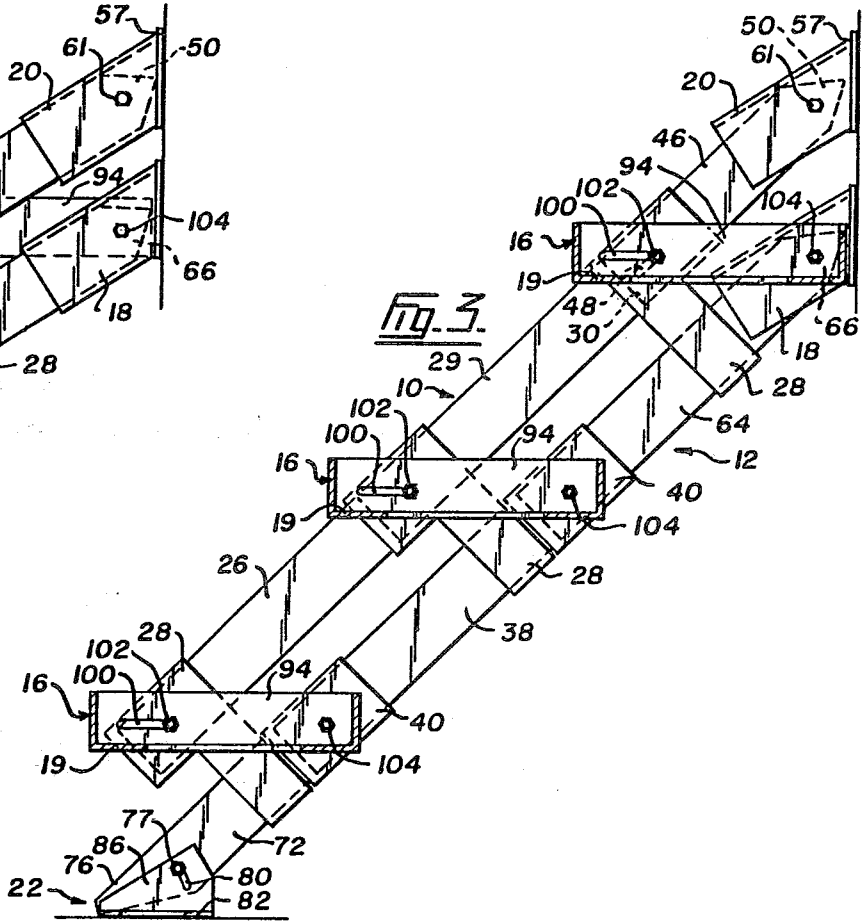
Figure 2:
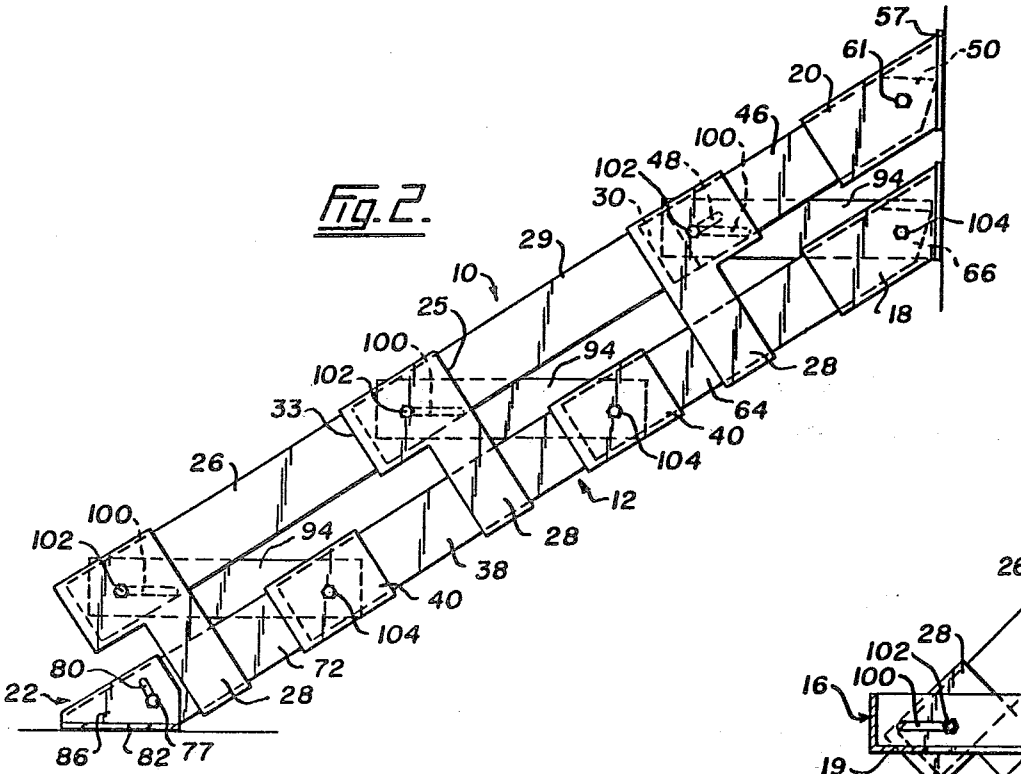
FIG. 2 is a side elevation view of the staircase assembly shown in FIG. 1.

Illustrated in FIG. 1 is an assembled modular staircase structure on each side of which there is an upper 10 and lower 12 stringer. At the top of each upper 10 and lower 12 stringer there is an upper 20 and lower 18 rotatable mounting pad and at the bottom of the lower stringer 12 there is a rotatable mounting pad 22. Interconnected across the upper 10 and lower 12 stringers are a plurality of spaced apart substantially horizontal tread supports 16 of right-angled cross section for supporting associated steps 17 which are mounted on a horizontal ledge 19 thereof.

The component parts of the assembly are illustrated in FIGS. 1, 2, 3 and 4. An upper stringer member 26 is affixed at a first end 29 at a first end 33 to a cross coupling bracket 28 which has a projecting arm 27 extending substantially perpendicularly to the stringer member 26. The distal end of the arm 27 has an aperture 36 which is substantially the same in cross section as the cross section of an associated lower stringer member 38 so that the latter is snugly slidably received in the aperture 36. The cross coupling bracket 28 also has an upper stringer receptacle 25 (see FIG. 2) of substantially the same cross section as the upper stringer member 26 for snugly slidably receiving a second end 31 of an adjacent upper stringer member 26. Proximate the second end 31 of the upper stringer member 26 there is located an aperture 32 which when inserted into the receptacle 30 of an adjacent cross coupling bracket 28 aligns with a corresponding hole 34 in the cross coupling bracket 28.

The lower stringer member 38 has affixed thereto at a first end 41 a stringer coupling bracket 40 having a receptacle 42 of substantially the same cross section as the cross section of the lower stringer member 38 for snugly slidably receiving an adjacent such stringer member along a common longitudinally extending axis. Each lower stringer member 38 has an aperture 44 proximate a second end 45 thereof which aligns with a corresponding aperture 47 in the stringer coupling bracket 40 when a second end 45 of an adjacent lower stringer member is fully inserted into the receptacle 42. When adjacent lower stringer members 38 are coupled by means of the stringer coupling bracket 40 they are also longitudinally aligned.

Figure 4:
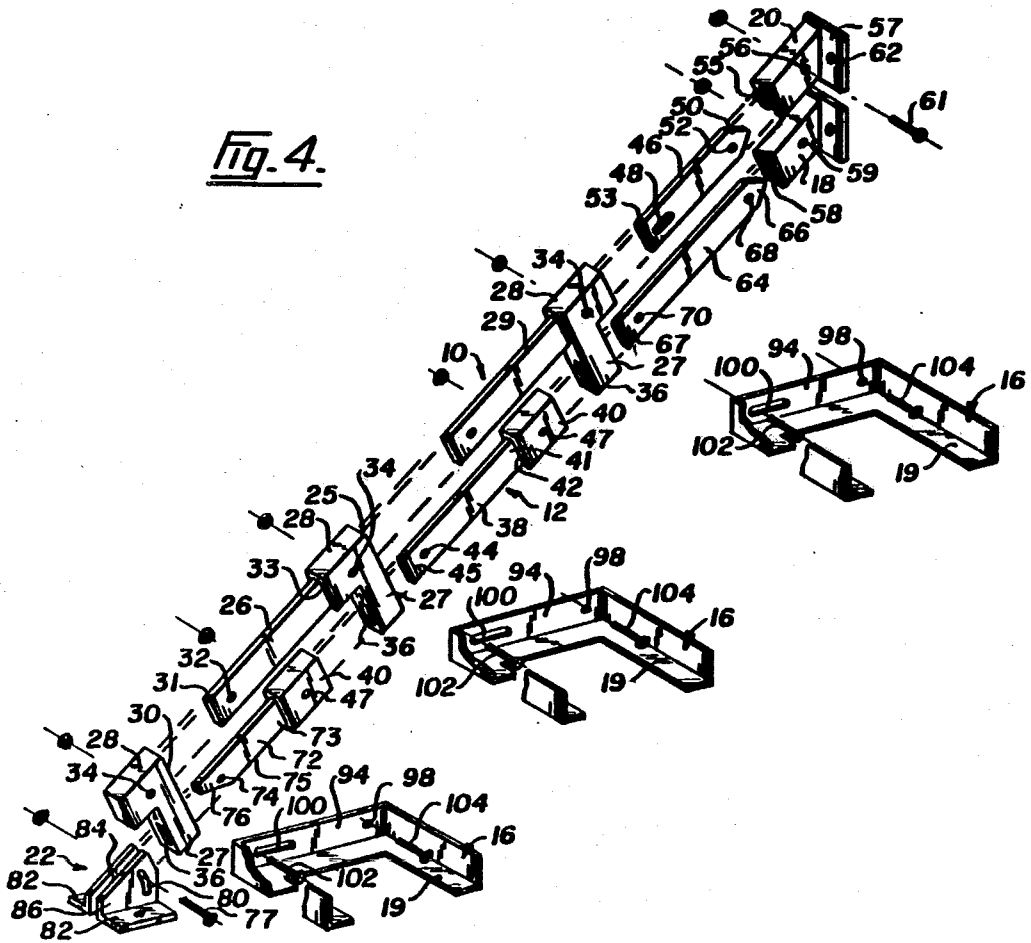
FIG. 4 is an exploded view of a side of the assembly of FIG. 1.

FIG. 4 illustrates an upper top end stringer member 46 having a V-shaped first end 50, an aperture 52 proximate to the first end 50 and a slot 48 proximate the other end 53 thereof. The upper mounting pad 18 has a slot 55 formed therein which corresponds in cross section to the cross section of the upper top end stringer member 46 and is adapted to snugly slidably receive the latter with the hole 52 of the latter stringer member 46 aligned with a hole 56 in the mounting pad 18. The distal end of the upper mounting pad 18 has a flange 57 through which there is a bolt hole 62 for bolting to a vertical wall portion (not shown).

A corresponding lower top end stringer member 64 has apertures 68 and 70 proximate respective first 66 and second 67 ends thereof. The first end 66 is snugly slidably insertable into the slot 58 of a corresponding lower mounting pad 20 until hole 68 proximate the first end 66 of the lower top end stringer member 64 aligns with corresponding holes 59 in the lower mounting pad 20. Pins or bolts 61 and 104 pass through pairs of aligned holes 52, 56 and 68, 59, respectively, to couple the respective members 46, 20 and 64, 18, respectively. A bottom lower stringer member 72 is affixed to a stringer coupling bracket 40 at a first end 73 thereof. The second end 76 of the bottom lower stringer member 72 forms an angle of approximately 150° with the bottom edge 75 of the lower stringer member 72. The end 76 is snugly slidably insertable between parallel spaced apart plates 84 and 86 (see FIG. 4) of a bottom foot pad 22. A hole 74 proximate the lower end 76 of the lower stringer member 72 aligns with an arcuate slot 80 through each of the parallel plates 84 and 86 of the bottom foot pad 22 to permit coupling of the two members by means of a pin or bolt 77. To the bottom end of each plate 84 and 86 of the foot pad 22 is affixed a flange 82 for resting on a floor portion (not shown).

With an upper stringer member 29 coupled to an upper top end stringer member 46 as illustrated in FIG. 4 and a lower top end stringer member 64, a tread support mounting plate 94 is mounted as shown by means of pin connections or bolts 104 and 102 passing through respective associated holes 98 and slot 100 in the tread support mounting plate 94. As best seen in FIG. 3 the tread support mounting plates 94 are mounted at their slotted sides to the upper stringer assembly through holes 34 in coupling brackets 28 and at their other side through holes 47 and 59 of stringer coupling brackets 40 and top lower mounting pad 18, respectively. In each case sliding of the cross coupling brackets 28 along the lower stringer member 38, lower top end stringer member 74 and lower bottom end stringer member 72 is permitted by movement of the coupling pin or bolt 102 passing through the slot 100 of the tread support mounting plate 94 and through the hole 34 in the associated cross coupling bracket 28.

Figure 7:
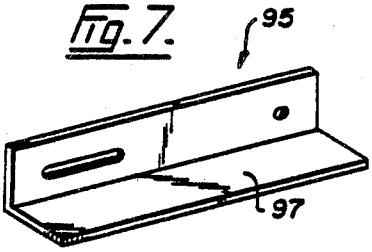
FIG. 7 is a perspective view of an alternate step support bracket.

An optional method for supporting a step is illustrated in FIG. 7. Here a simple bracket 95 having a shelf 97 for supporting a step plate (not shown) is illustrated. The bracket 95 is identical to the mounting plate 94 except that there are no members coupling opposed associated tread support brackets 95.

Figure 5:
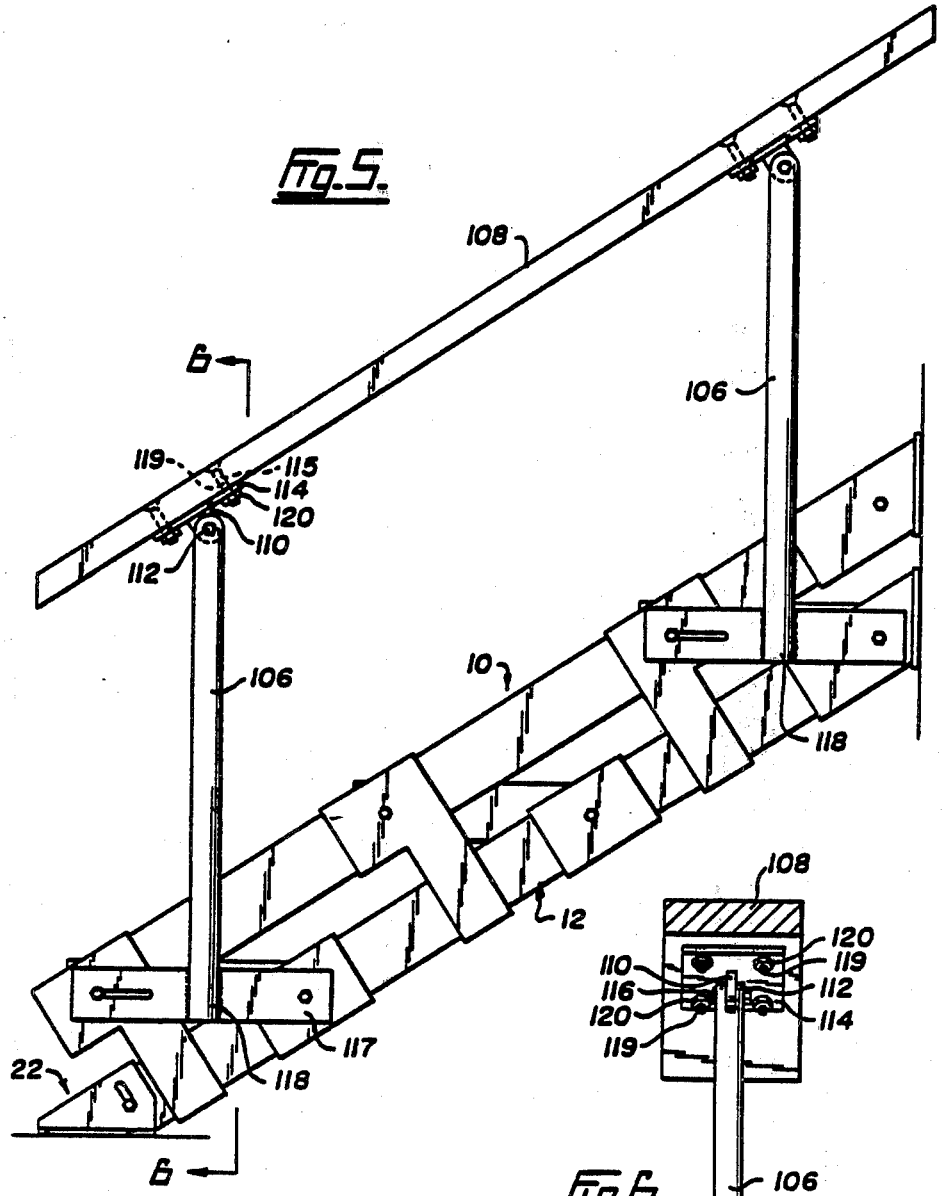
FIG. 5 is a side elevation view of the assembly with a handrail affixed thereto.
Figure 6:
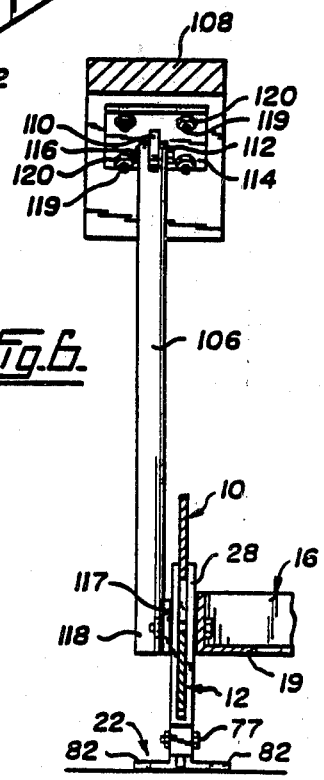
FIG. 6 is a sectional view along the line 6—6 seen in FIG. 5.

FIGS. 5 and 6 reveal a coupling assembly for a hand rail 108. A substantially vertical support 106 is affixed at its lower end 118 to an associated tread support mounting plate 94. The lower end 118 may be affixed to the tread mounting support plate 117 by either bolts or by welding depending upon the material selected for the support post 106. The top end of the support post 106 is pivotally coupled to a bracket 110 by means of a bolt 112 and a treadedly received nut 116. To the bracket 110 is affixed a plate 114 having bolt holes 115 at either end. Bolts 119 passing through recessed bolt holes 115 the hand rail and through the bolt holes in the plate 114 are secured at the back of the latter plate by nuts 120. The staircase assembly illustrated in the aforementioned figures is initially assembled to a desired length and then with all of the interconnecting pins or bolts loosened the assembly is tilted to the proper orientation. Slots 100 and 48 permit top upper stringer member 46 to slide within aperture 30 of its associated cross-coupling bracket 28. Subsequent tightening of the bolts ensures that the mounting pads 18 and 20 and the foot pads 22 are properly oriented relative to the respective wall and the floor portions to which they are to be affixed. The geometry of the structure is such that the rise can be maintained betwee 7 and 9 inches for all of the usual orientations of the staircase assembly.

Once the orientation and desired length is established installation of the hand rail may be accomplished by affixing the post supports 106 to the tread support mounting plates 94. Finally, the hand rail 108 itself is connecting to the support post 106.

Other variations, modifications and departures within the spirit of the invention and scope thereof as defined by the appended claims will be obvious to those skilled in the art.

I claim:

1. A modular staircase assembly, comprising:

(a) a plurality of upper stringer members;

(b) a plurality of lower stringer members;

(c) means for coupling said upper and lower stringer members in parallel spaced apart positions such that one of said upper and lower members is slidable with respect to the other;

(d) means for connecting a first end of said upper and lower stringer members to a second end of adjacent respective upper and lower stringer members such that the connected members are longitudinally aligned;

(e) a tread support pivotally couplable to said upper and lower stringer members;

(f) a mounting pad assembly couplable to one of said first and second ends of said upper and lower stringer members for mounting to a wall portion; and (g) a foot pad assembly couplable to the other of said first and second ends of said upper and lower stringer members for mounting on a floor portion.

2. A modular staircase assembly as defined by claim 1, wherein said stringer coupling means is a coupling member rigidly affixable to one of said upper and lower stringer members and having a projecting arm extending perpendicularly from said one stringer member, the distal end of the arm having an opening for snugly, slidably receiving said other stringer member.

3. A modular staircase assembly as defined by claim 1, wherein said stringer connecting means includes a coupling member rigidly affixable to the first end of each of said upper and lower stringer members having a receptacle of substantially the same cross section as said stringer member and aligned therewith for snugly, slidably receiving the second end of an adjacent stringer member.

4. A modular staircase assembly as defined by claim 1, wherein said stringer coupling means and said stringer connecting means for one of said upper and lower stringer members includes a coupling member rigidly affixable to the first end of said one stringer member and having a receptacle of substantially the same cross section as said one stringer member and aligned therewith, said coupling member when affixed to said one stringer member, having a projecting arm extending perpendicularly to said one stringer member, the distal ends of the arm having an opening for snugly, slidably receiving said other stringer member.

5. A modular staircase assembly as defined by claim 4, wherein said stringer connecting means for said other stringer member includes a sleeve rigidly affixable to the first end of said other stringer member and having a receptacle of substantially the same cross section as said other stringer member for snugly, slidably receiving a second end of an adjacent stringer member.

6. A modular staircase assembly as defined by claim 1, wherein said mounting pad assembly includes upper and lower top end stringer members having pivotally coupled at respective mounting ends associated clamping plate members for attachment to a wall portion and said foot pad assembly includes a lower end bottom stringer section having pivotally coupled thereto at a supporting end a foot member for positioning on a floor portion.

7. A modular staircase assembly as defined by claim 4 wherein the arms, said tread support and the portion of said other stringer member between the arm and one end of said tread support form a triangle.

8. A modular staircase assembly, comprising:

(a) an upper stringer member having a substantially uniform rectangular cross section;

(b) a lower stringer member having a substantially uniform rectangular cross section;

(c) a stringer cross coupling bracket affixed to a first end of said upper stringer member having a projecting arm extending perpendicularly to said upper stringer member, the distal end of the arm having an aperture of substantially the same cross section as said lower stringer member for snugly, slidably receiving the latter in spaced apart parallel relationship to said upper stringer member and said cross coupling bracket having an upper stringer receptacle of substantially the same cross section as said upper stringer member for snugly, slidably receiving a second end of an adjacent upper stringer member such that said interconnected upper stringer members are longitudinally aligned;

(d) a stringer coupling bracket affixed to a first end of said lower stringer member having a lower stringer receptacle of substantially the same cross section and said lower stringer member for snugly, slidably receiving a second end of an adjacent lower stringer member such that said interconnected lower stringer members are longitudinally aligned;

(e) a tread support bracket pivotally affixed at one end to one of said stringer cross coupling brackets and stringer coupling brackets and slotted at the other end for slidable connection to the other of said brackets such that as said lower stringer member slides through the aperture of the projecting arm, the tread support slides relative to said associated cross coupling bracket;

(f) a mounting pad assembly couplable to one of said first and second ends of said upper and lower stringer members for mounting to a wall portion;

(g) a foot pad assembly couplable to the other of said first and second ends of said upper and lower stringer members for mounting on a floor portion.

9. A modular staircase assembly as defined by claim 8, wherein said mounting pad assembly includes upper and lower top end stringer members having pivotally coupled at respective mounting ends associated clamping plate members for attachment to a wall portion and said foot pad assembly includes a lower bottom end stringer member having pivotally coupled thereto at a supporting end a foot member for positioning on a floor portion.

10. A modular staircase assembly as defined by claim 8, further comprising a plurality of hand rail posts each rigidly affixable at a bottom end thereof to an associated tread support and pivotally affixable at a top end thereof to a hand rail.

11. A modular staircase assembly as defined by claim 8 wherein said tread support bracket, said cross coupling bracket and the portion of the lower stringer member intermediate the cross-coupling bracket and the lower stringer member form a triangle.

* * * * *